US010460671B2

(12) United States Patent
Shi

(10) Patent No.: US 10,460,671 B2
(45) Date of Patent: Oct. 29, 2019

(54) SCANNING DRIVING CIRCUIT AND DISPLAY APPARATUS

(71) Applicant: Shenzhen China Star Optoelectronics Semiconductor Display Technology Co., Ltd., Shenzhen, Guangdong (CN)

(72) Inventor: Longqiang Shi, Guangdong (CN)

(73) Assignee: Shenzhen China Star Optoelectronics Semiconductor Display Technology Co., Lltd, Shenzhen, Guangdong (CN)

( * ) Notice: Subject to any disclaimer, the term of this patent is extended or adjusted under 35 U.S.C. 154(b) by 144 days.

(21) Appl. No.: 15/557,437

(22) PCT Filed: Aug. 18, 2017

(86) PCT No.: PCT/CN2017/097991

§ 371 (c)(1),
(2) Date: Sep. 11, 2017

(87) PCT Pub. No.: WO2019/006830

PCT Pub. Date: Jan. 10, 2019

(65) Prior Publication Data

US 2019/0012966 A1 Jan. 10, 2019

(30) Foreign Application Priority Data

Jul. 4, 2017 (CN) ..... 2017 1 0537419

(51) Int. Cl.
*G09G 3/3266* (2016.01)
*G09G 3/36* (2006.01)

(52) U.S. Cl.
CPC ..... *G09G 3/3266* (2013.01); *G09G 3/3677* (2013.01); *G09G 2310/0286* (2013.01);
(Continued)

(58) Field of Classification Search
None
See application file for complete search history.

(56) References Cited

U.S. PATENT DOCUMENTS

2010/0226473 A1 9/2010 Liu et al.
2011/0142192 A1* 6/2011 Lin ..... G09G 3/3677 377/77

(Continued)

FOREIGN PATENT DOCUMENTS

CN 104809973 A 7/2015
CN 106057157 A 10/2016

(Continued)

*Primary Examiner* — Amr A Awad
*Assistant Examiner* — Andre L Matthews
(74) *Attorney, Agent, or Firm* — Andrew C. Cheng

(57) ABSTRACT

The present application discloses a scanning driving circuit and a display apparatus. The scanning driving circuit includes a scanning signal output terminal; a pull-up circuit controlling the scanning signal output terminal to output a high level scanning signal; a transmission circuit for outputting a stage transmission signal of a current stage; a pull-up control circuit to charge the pull-up control signal point; a pull-down maintaining circuit maintains the low level of the pull-up control signal point and the scanning signal output terminal and releases the high potential of the pull-up control signal point; a bootstrap circuit raises the potential of the pull-up control signal point; a pull-down circuit controls the scanning signal output terminal to output a low level, thereby solving the problem of the large current generated when the display device is turned on and off.

17 Claims, 3 Drawing Sheets

(52) U.S. Cl.
CPC ..... *G09G 2310/06* (2013.01); *G09G 2310/08* (2013.01); *G09G 2320/04* (2013.01); *G09G 2330/025* (2013.01)

(56) References Cited

U.S. PATENT DOCUMENTS

| | | | | |
|---|---|---|---|---|
| 2015/0171833 | A1 | 6/2015 | Pi et al. | |
| 2015/0288364 | A1* | 10/2015 | Lin | H03K 19/00384 377/75 |
| 2016/0019828 | A1* | 1/2016 | Lin | G09G 3/20 345/214 |
| 2016/0140922 | A1* | 5/2016 | Dai | G11C 19/287 345/92 |
| 2016/0240158 | A1 | 8/2016 | Xu | |
| 2016/0351152 | A1 | 12/2016 | Dai | |
| 2017/0124971 | A1 | 5/2017 | Tu et al. | |
| 2017/0213512 | A1 | 7/2017 | Dai | |
| 2017/0301277 | A1* | 10/2017 | Shang Guan | G09G 3/2092 |
| 2018/0211627 | A1* | 7/2018 | Shi | G09G 3/3677 |
| 2018/0277043 | A1* | 9/2018 | Li | G11C 19/28 |
| 2019/0049768 | A1* | 2/2019 | Lv | G02F 1/13306 |
| 2019/0073978 | A1* | 3/2019 | Shi | G09G 3/3677 |

FOREIGN PATENT DOCUMENTS

| | | | |
|---|---|---|---|
| CN | 106128401 | A | 11/2016 |
| CN | 106601205 | A | 4/2017 |
| CN | 106898290 | A | 6/2017 |

* cited by examiner

SCANNING DRIVING CIRCUIT AND DISPLAY APPARATUS

FIELD OF THE INVENTION

The present application relates to a display technology field, and more particularly to a scanning driving circuit and a display apparatus.

BACKGROUND OF THE INVENTION

Gate Driver on Array, GOA technology is conducive to the design of narrow bezel of the display panel and cost reduction, so it is widely used and studied. A situation of quickly turning on and turning off is usually occurred in the conventional display apparatus. The scanning driving circuit of the conventional display apparatus is shown in FIG. 1, and the corresponding signal waveform is shown in FIGS. 2 and 3. When the display apparatus is turned off quickly, the potential of the pull-up control signal point Q(N) of the scanning driving circuit cannot be released in a short time is presented, when the display apparatus is turned on again quickly, the thin film transistor T21 controlled by the pull-up control signal point Q(N) is turned on, a clock signal CK(n) of a current stage is written, so that the scanning signal output terminal G(N) has a multi-peak value, resulting in a large current.

SUMMARY OF THE INVENTION

The technical problem that the present application mainly solves is to provide a scanning driving circuit and a display apparatus to solve the problem of large current generated when the switch is quickly turned on and off.

In order to solve the above technical problems, a technical aspect of the present application is to provide a scanning driving circuit including:

a first voltage terminal;

a second voltage terminal;

a scanning signal output terminal for outputting a high level scanning signal or a low level scanning signal;

a pull-up circuit for receiving a clock signal of a current stage and controlling the scanning signal output terminal to output of a high level scanning signal according to the clock signal of the current stage;

a transmission circuit, connected to the pull-up circuit for outputting a high level stage transmission signal of a current stage;

a pull-up control circuit, connected to the transmission circuit and receiving a stage transmission signal of a previous stage for charging the pull-up control signal point to pull up the potential of the pull-up control signal point to a high level;

a pull-down maintenance circuit connected to the pull-up control circuit, the first voltage terminal and the second voltage terminal and receiving a high voltage direct current voltage, for maintaining the low level of the pull-up control signal point, and the low level of the scanning signal outputted from the scanning signal output terminal;

a bootstrap circuit for raising the potential of the pull-up control signal point;

a pull-down circuit connected to the transmission circuit, the pull-down maintenance circuit, and the first voltage terminal, for receiving a stage transmission signal of a next stage and controlling the scanning signal output terminal to output the low level scanning signal in accordance with the stage transmission signal of the next stage; wherein the pull-up circuit including a first controllable switch, a first terminal of the first controllable switch receiving the clock signal of the current stage, a control terminal of the first controllable switch is connected to the transmission circuit and the pull-down circuit, a second terminal of the first controllable switch is connected to the transmission circuit and the scanning signal output terminal; and wherein when the scanning driving circuit is not operated, the second voltage terminal is at high potential, and when the scanning driving circuit is operated, the second voltage terminal becomes a low potential, and the low potential is the same with the first voltage terminal.

In order to solve the above technical problems, a technical aspect of the present application is to provide a scanning driving circuit including:

a first voltage terminal;

a second voltage terminal;

a scanning signal output terminal for outputting a high level scanning signal or a low level scanning signal;

a pull-up circuit for receiving a clock signal of a current stage and controlling the scanning signal output terminal to output of a high level scanning signal according to the clock signal of the current stage;

a transmission circuit, connected to the pull-up circuit for outputting a high level stage transmission signal of a current stage;

a pull-up control circuit, connected to the transmission circuit and receiving a stage transmission signal of a previous stage for charging the pull-up control signal point to pull up the potential of the pull-up control signal point to a high level;

a pull-down maintenance circuit connected to the pull-up control circuit, the first voltage terminal and the second voltage terminal and receiving a high voltage direct current voltage, for maintaining the low level of the pull-up control signal point, and the low level of the scanning signal outputted from the scanning signal output terminal;

a bootstrap circuit for raising the potential of the pull-up control signal point; and a pull-down circuit connected to the transmission circuit, the pull-down maintenance circuit, and the first voltage terminal, for receiving a stage transmission signal of a next stage and controlling the scanning signal output terminal to output the low level scanning signal in accordance with the stage transmission signal of the next stage.

In order to solve the above technical problems, a technical aspect of the present application is to provide a display apparatus, wherein the display apparatus including any one of the scanning driving circuit described above.

The advantages of the present application is: comparing to the conventional technology, the scanning driving circuit and the display apparatus pull down the high potential of the pull-up control signal point when the scanning driving circuit is inoperative through the first voltage terminal, the second voltage terminal, the pull-up circuit, the transmission circuit, the pull-up control circuit, the pull-down maintenance circuit, the pull-down circuit and the bootstrap circuit, so that the high potential of the pull-up control signal point is released before the operating of the scanning driving circuit, in order to solve the high current issue generated by turning on and off the display apparatus.

BRIEF DESCRIPTION OF THE DRAWINGS

In order to more clearly illustrate the embodiments of the present application or prior art, the following FIG.s will be described in the embodiments are briefly introduced. It is obvious that the drawings are merely some embodiments of the present application, those of ordinary skill in this field can obtain other FIG.s according to these FIG.s without paying the premise.

DETAILED DESCRIPTION OF PREFERRED EMBODIMENTS

Embodiments of the present application are described in detail with the technical matters, structural features, achieved objects, and effects with reference to the accompanying drawings as follows. It is clear that the described embodiments are part of embodiments of the present application, but not all embodiments. Based on the embodiments of the present application, all other embodiments to those of ordinary skill in the premise of no creative efforts acquired should be considered within the scope of protection of the present application.

Specifically, the terminologies in the embodiments of the present application are merely for describing the purpose of the certain embodiment, but not to limit the invention.

Figure 1:
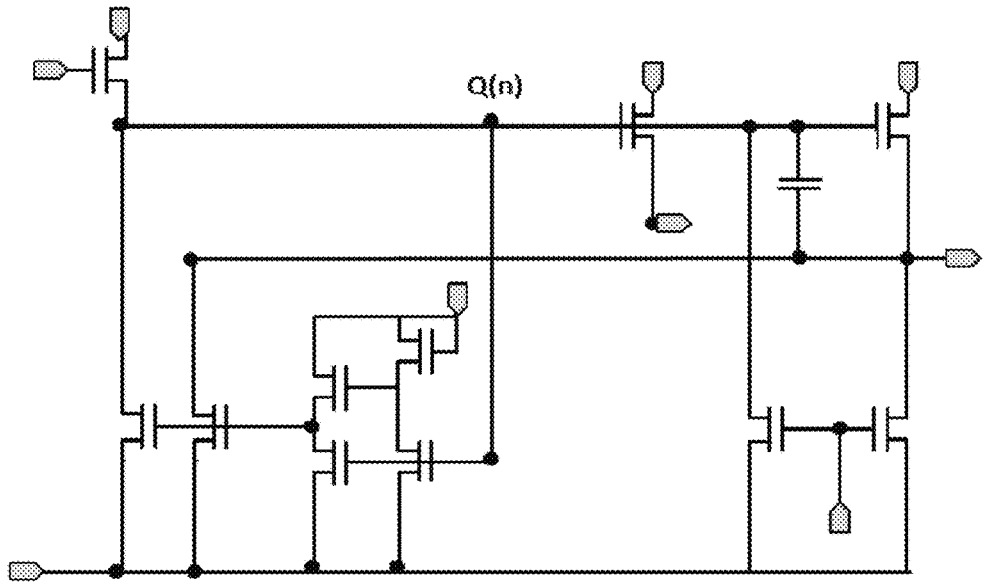
FIG. 1 (Prior Art)
FIG. 1 is a schematic diagram of a conventional scanning driving circuit.
Figure 2:
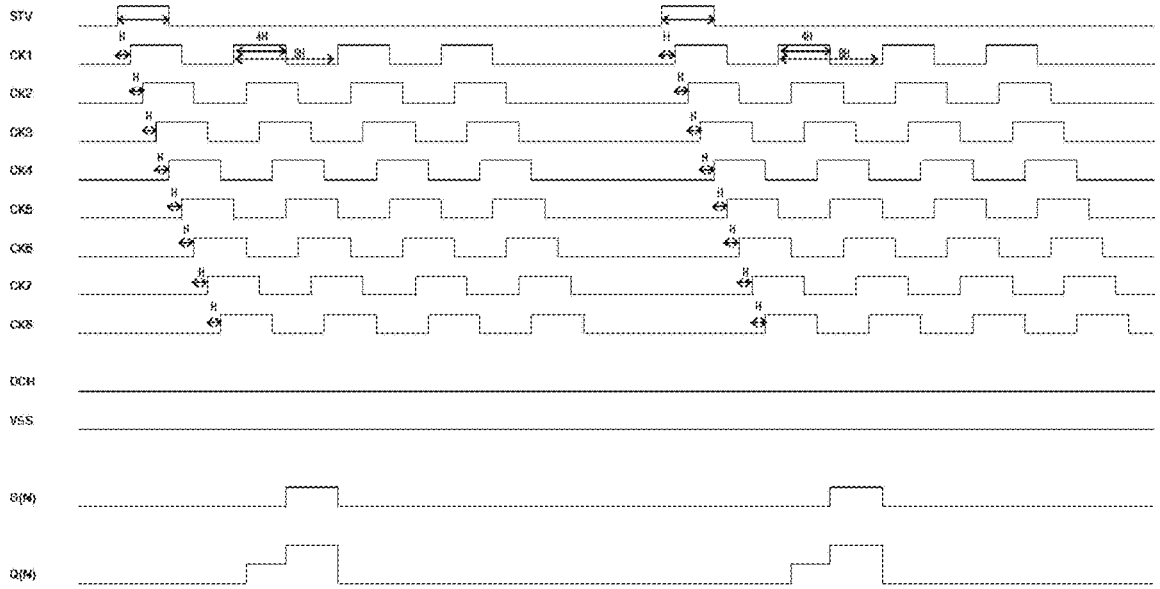
FIG. 2 (Prior Art)
FIG. 2 is a schematic diagram of the signal waveform of FIG. 1.
Figure 3:
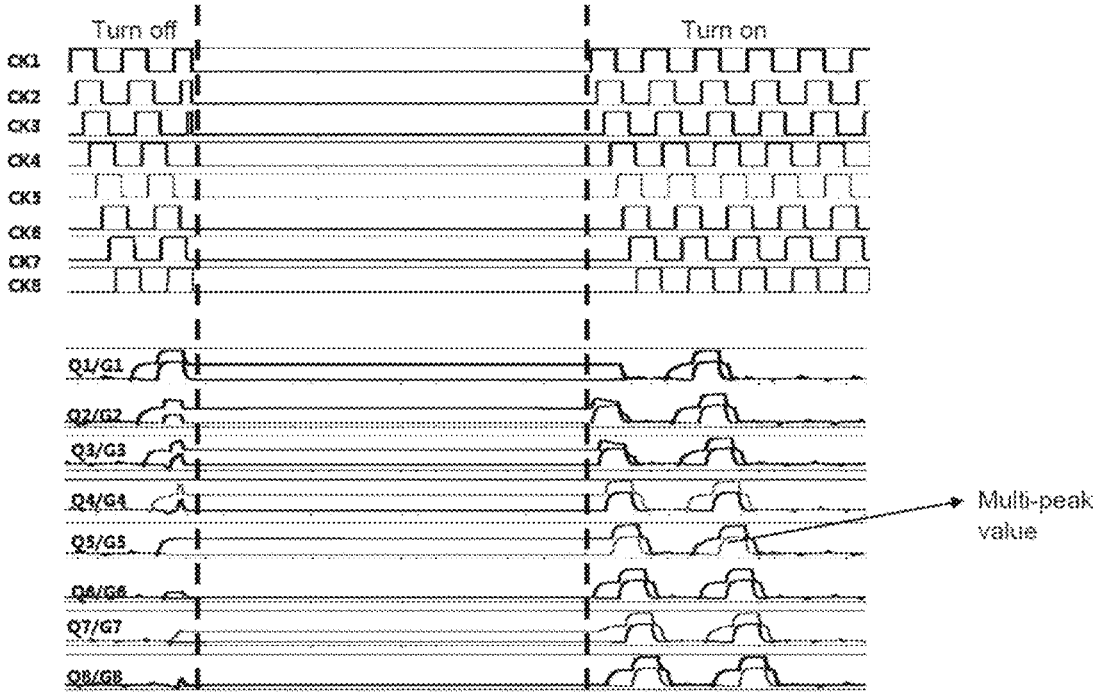
FIG. 3 (Prior Art)
FIG. 3 is a schematic diagram of a signal waveform of the scanning driving circuit during quickly turning on and turning off.
Figure 4:
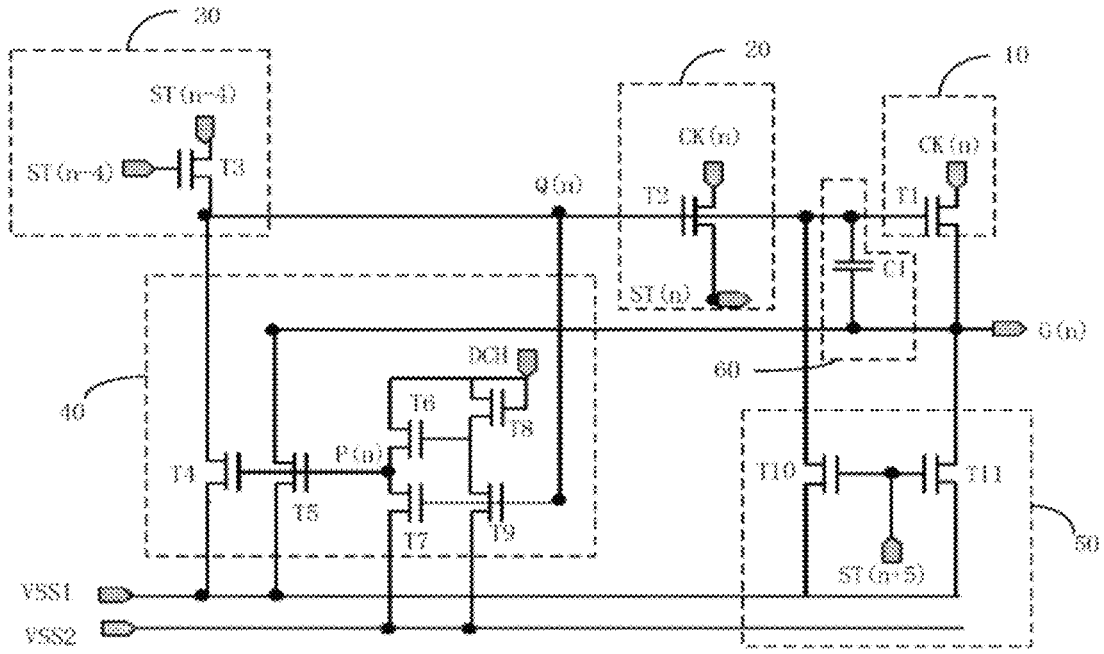
FIG. 4 is a circuit diagram of a scanning driving circuit of the present application.

Referring to FIG. 4, FIG. 4 is a circuit diagram of a scanning driving circuit of the present application. The scanning driving circuit includes a plurality of scanning driving units connected successively, each of the scanning driving unit 1 includes a first voltage terminal VSS1; a second voltage terminal VSS2; a scanning signal output terminal G(n) for outputting a high level scanning signal or a low level scanning signal; a pull-up circuit 10 for receiving a clock signal of a current stage CK(n) and controlling the scanning signal output terminal G(n) to output of a high level scanning signal according to the clock signal of the current stage CK(n); a transmission circuit 20, connected to the pull-up circuit 10 for outputting a high level stage transmission signal of a current stage ST(n); a pull-up control circuit 30, connected to the transmission circuit 20 and receiving a stage transmission signal of a previous stage ST(n−4) for charging the pull-up control signal point Q(n) to pull up the potential of the pull-up control signal point Q(n) to a high level; a pull-down maintenance circuit 40 connected to the pull-up control circuit 30, the first voltage terminal VSS1 and the second voltage terminal VSS2 and receiving a high voltage direct current voltage DCH, for maintaining the low level of the pull-up control signal point Q(n), and the low level of the scanning signal outputted from the scanning signal output terminal G(n); a bootstrap circuit 60 for raising the potential of the pull-up control signal point Q(n); a pull-down circuit 50 connected to the transmission circuit 20, the pull-down maintenance circuit 40, and the first voltage terminal VSS1, for receiving a stage transmission signal of a next stage ST(n+5) and controlling the scanning signal output terminal G(n) to output the low level scanning signal in accordance with the stage transmission signal of the next stage ST(n+5).

In the present embodiment, the stage transmission signal of the previous stage ST(n−4) is the preceding fourth stage transmission signal of the stage transmission signal of the current stage ST(n), the stage transmission signal of the next stage ST(n+5) is the next fifth stage transmission signal of the stage transmission signal of the current stage ST(n).

Wherein, the pull-up circuit 10 includes a first controllable switch T1, a first terminal of the first controllable switch T1 receiving the clock signal of the current stage CK(n) and is connected to the transmission circuit 20, a control terminal of the first controllable switch T1 is connected to the transmission circuit 20 and the pull-down circuit 60, and a second terminal of the first controllable switch T1 is connected to the transmission circuit 20 and the scanning signal output terminal G(n).

Wherein, the transmission circuit 20 includes a second controllable switch T2, a control terminal of the second controllable switch T2 is connected to the control terminal of the first controllable switch T1, and a first terminal of the second controllable switch T2 is connected to the first terminal of the first controllable switch T1, and a second terminal of the second controllable switch T2 outputs the stage transmission signal of the current stage ST(n).

Wherein, the pull-up control circuit 30 includes a third controllable switch T3, a control terminal of the third controllable switch T3 is connected to a first terminal of the third controllable switch T3 and receives the stage transmission signal of the previous stage ST(n−4), a second terminal of the third controllable switch T3 is connected to the control terminal of the second controllable switch T2 and the pull-down maintenance circuit 40.

Wherein the pull-down maintenance circuit 40 includes fourth to ninth controllable switches T4-T9, a control terminal of the fourth controllable switch T4 is connected to a control terminal of the fifth controllable switch T5, a first terminal of the controllable switch T4 is connected to the second terminal of the third controllable switch T3, a second terminal of the fourth controllable switch T4 is connected to the first voltage terminal VSS1, a first terminal of the fifth controllable switch T5 is connected to the scanning signal output terminal G(n), a second terminal of the fifth controllable switch T5 is connected to the first voltage terminal VSS1, a second terminal of the sixth controllable switch T6 is connected to a first terminal of the seventh controllable switch T7 and the control terminal of the fifth controllable switch T5, a first terminal of the sixth controllable switch T6 is connected to a first terminal of the eighth controllable switch T8 and a control terminal of the eighth controllable switch T8 and to receive the high voltage direct current voltage DCH, a control terminal of the sixth controllable switch T6 is connected to the second terminal of the eighth controllable switch T8 and a first terminal of the ninth controllable switch T9, a control terminal of the seventh controllable switch T7 is connected to a control terminal of the ninth controllable switch T9 and the second terminal of the third controllable switch T3, a second terminal of the seventh controllable switch T7 and a second terminal of the ninth controllable switch T9 are both connected to the second voltage terminal VSS2.

Wherein the pull-down circuit 50 includes a tenth controllable switch T10 and an eleventh controllable switch T11, a control terminal of the tenth controllable switch T10 is connected to a control terminal of the eleventh controllable switch T11 and receives the stage transmission signal of the next stage ST(n+5), a first terminal of the tenth controllable switch T10 is connected to the control terminal of the second controllable switch T2, a second terminal of the tenth controllable switch T10 is connected the first voltage terminal VSS1, a first terminal of the eleventh controllable switch T11 is connected to the scanning signal output terminal G(n) and the second terminal of the first controllable switch T1, a second terminal of the eleventh controllable switch is connected to the first voltage terminal VSS1.

Wherein the bootstrap circuit 60 includes a bootstrap capacitor C1, a first terminal of the bootstrap capacitor C1 is connected to the control terminal of the first controllable switch T1 and the first terminal of the tenth controllable switch T10, a second terminal of the bootstrap capacitor C1 is connected to the scanning signal output terminal G(n) and the first terminal of the fifth controllable switch T5.

In the present embodiment, the first to eleventh controllable switches T1-T11 are N-type thin film transistors, the control terminals, the first terminals and the second terminals of the first to eleventh controllable switches T1-T11 are respectively correspond to gates, sources and drains of the N-type thin film transistor. In other embodiments, the first to twelfth controllable switches can be other types of switches as long as the object of the present application can be achieved.

Specifically, when the scanning driving circuit is not operated, the second voltage terminal VSS2 is at a high potential, and when the scanning driving circuit is operated, the second voltage terminal VSS2 becomes a low potential, and is the low potential the same with the first voltage terminal VSS1. Wherein the high potential is 28V and the low potential is −7V.

Specifically, the present application is described as an example of the 8K4K display. The driving signal STV is an initial signal, which is an alternating current, each frame is turned on once, the high potential is 28V, the low potential is −7V, and the time of the driving signal STV is 4H (each H is a time for one data), in which eight clock signals are adapted, the clock signals CK are all high frequency alternating current power supply, the pulse width of each of the clock signal CK is 4H of the time, the period is 8H of the time, the time between the two adjacent clock signals CK is different by 1H of the time, wherein the clock signal CK1 has a delay, the high potential of each clock signal CK is 28V, the low potential is −7V, and the high voltage direct current voltage DCH is 28V.

In the present embodiment, the scanning driving circuit uses eight clock signals CK, the stage transmission signal ST(n−4) is connecting the stage transmission signal of the preceding fourth stage, for example, the previous stage (i.e. the current stage) is $10^{th}$ stage, the ST(n)=ST(10), ST(n−4)=ST(6), ST(n+5)=ST(15), that is, the first terminal and the control terminal of the third controllable switch T3 are connected to the sixth stage of the stage transmission signal ST(6). Wherein, the third controllable switches T3 of the scanning driving unit 1 for each stage of the preceding four stages are all connected to the driving signal STV, and the stage transmission signal of the following fifth stages ST(n+5) is replaced by the driving signal STV.

Figure 5:
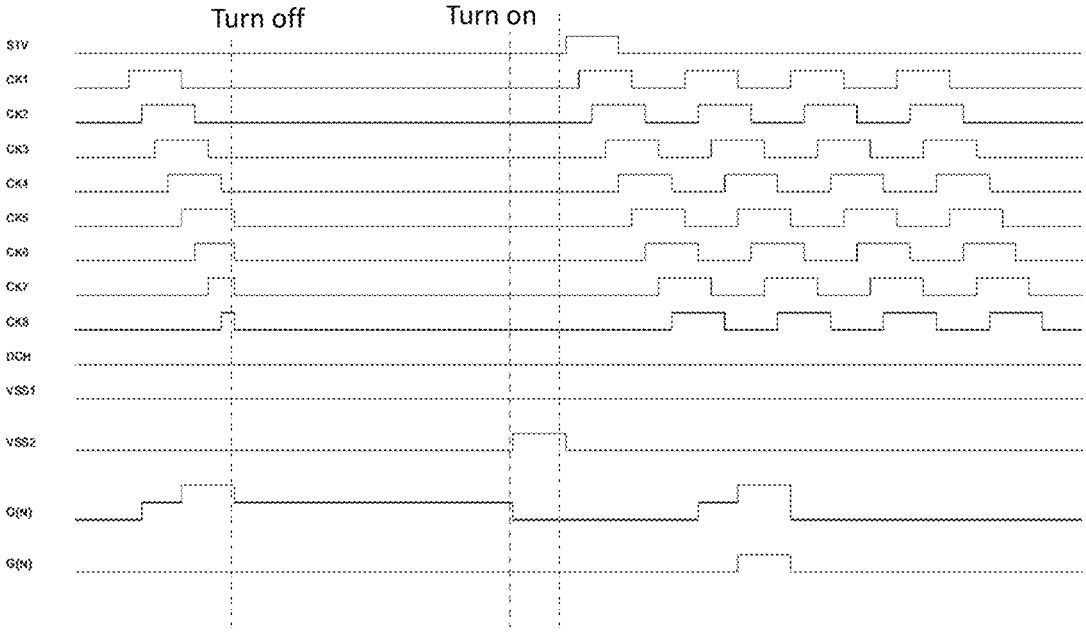
FIG. 5 is a schematic diagram of the signal waveform of FIG. 4.

Referring to FIGS. 4 and 5, the scanning driving circuit of the present embodiment is described by taking the operation principle of the 32nd stage scanning driving unit as an example. That is G(n)=G(32), ST(n−4)=ST(28), ST(n+5) =ST(37), the scanning signal outputted from the scanning signal output terminal G(32) is controlled by the clock signal CK8, the stage transmission signal ST(28) is controlled by the clock signal CK4.

When the scanning driving circuit is normally operated, the first voltage terminal VSS1 and the second voltage terminal VSS2 are the same low potential, the stage transmission signal ST(28) is at a high potential, the clock signal CK4 is at a high potential, the third controllable switch T3 is turned on, the high potential of the stage transmission signal ST(28) is transmitted to the pull-up control signal point Q(32), the pull-up control signal point Q(32) is at a high potential, the first controllable switch T1 is turned on at this time, the clock signal CK8 is at a low potential, so the scanning signal outputted from the scanning signal output terminal G(32) is at a low potential, at the same time, the seventh controllable switches T7 and the ninth controllable switch T9 are both turned on, so that the second voltage terminal VSS2 pulls down the potential of the pull-down control signal point P(32), at this time the fourth controllable switch T4 and the fifth controllable switches T5 are both turned off, the low potential of the first voltage terminal VSS1 does not affect the low potential of the scanning signal outputted from the scanning signal output terminal G(32).

When the stage transmission signal ST(28) is at low potential, the clock signal CK4 is at a low potential, the third controllable switch T3 is turned off, the clock signal CK8 is at a high potential at this time, the scanning signal outputted from the scanning signal output terminal G(32) is at a high potential, the pull-up control signal point Q(32) is raised to a higher potential by the coupling effect of the capacitor C1, the pull-down control signal point P(32) goes on to maintain at a low potential. At this time, the fourth controllable switch T4 and the fifth controllable switch T5 are both turned off, the low potential of the first voltage terminal VSS1 does not pull down the high potential of the scanning signal outputted from the scanning signal output terminal G(32).

After the display apparatus is turned off and before the power is turned on (that is when the scanning driving circuit is not in operation), the first voltage terminal VSS1 is at a low potential and the second voltage terminal VSS2 is at a high potential, since the high potential of the second voltage terminal VSS2 is 28V, which is greater than the potential of the pull-up control signal point Q(32) at this time, so that the voltage Vgs between the gate and the source of the seventh controllable switch T7 and the ninth controllable switch T9 is Vgs=VQ(32)−VSS2<=0, that is, the seventh controllable switch T7 and the ninth controllable switch T9 are both turned off, at this time the high voltage direct current voltage DCH provides a high potential, the sixth controllable switch T6 and the eighth controllable switch T8 are both turned on, so that the pull-down control signal point P(32) is at a high potential, the fourth controllable switch T4 and the fifth controllable The switch T5 are both turned on, so that the first voltage terminal VSS1 pulls down the potential of the pull-up control signal point Q(32), and makes the high potential of the pull-up control signal point Q(32) is released.

When the display apparatus is turned on again (that is when the scanning driving circuit is operated), the stage transmission signal ST(28) is at high potential, the clock signal CK4 is at a high potential, the third controllable switch T3(32) is turned on, the pull-up control signal point Q(32) is charged to a high potential, when the high potential of the pull-up control signal point Q(32) is greater than the high potential of the second voltage terminal VSS2, the seventh controllable switch T7 and the ninth controllable switch T9 are both turned on, the pull-down control signal point P(32) pulls down the high potential of the second voltage terminal VSS2 to the same low potential of the first Voltage terminal VSS1.

Figure 6:
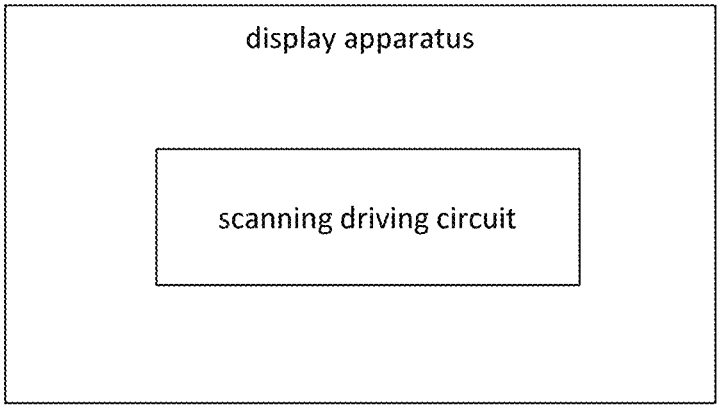
FIG. 6 is a schematic structural view of a display apparatus according to the present application.

Referring to FIG. 6, FIG. 6 is a schematic structural view of a display apparatus according to the present application.

The display apparatus includes the above-described scanning driving circuit, the display apparatus an LCD or an OLED, the other devices and functions of the display apparatus are the same as those of the conventional display apparatus, and will not be described again.

The scanning driving circuit and the display apparatus pull down the high potential of the pull-up control signal point when the scanning driving circuit is inoperative through the first voltage terminal, the second voltage terminal, the pull-up circuit, the transmission circuit, the pull-up control circuit, the pull-down maintenance circuit, the pull-down circuit and the bootstrap circuit, so that the high potential of the pull-up control signal point is released before the operating of the scanning driving circuit, in order to solve the high current issue generated by turning on and off the display apparatus.

Above are embodiments of the present application, which does not limit the scope of the present application. Any modifications, equivalent replacements or improvements within the spirit and principles of the embodiment described above should be covered by the protected scope of the invention.

What is claimed is:

1. A scanning driving circuit, comprising: a first voltage terminal; a second voltage terminal; a scanning signal output terminal for outputting a high level scanning signal or a low level scanning signal;

a pull-up circuit for receiving a clock signal of a current stage and controlling the scanning signal output terminal to output of a high level scanning signal according to the clock signal of the current stage;

a transmission circuit, connected to the pull-up circuit for outputting a high level stage transmission signal of a current stage; a pull-up control circuit, connected to the transmission circuit and receiving a stage transmission signal of a previous stage for charging the pull-up control signal point to pull up the potential of the pull-up control signal point to a high level;

a pull-down maintenance circuit connected to the pull-up control circuit, the first voltage terminal and the second voltage terminal and receiving a high voltage direct current voltage, for maintaining the low level of the pull-up control signal point, and the low level of the scanning signal outputted from the scanning signal output terminal;

a bootstrap circuit for raising the potential of the pull-up control signal point;

a pull-down circuit connected to the transmission circuit, the pull-down maintenance circuit, and the first voltage terminal, for receiving a stage transmission signal of a next stage and controlling the scanning signal output terminal to output the low level scanning signal in accordance with the stage transmission signal of the next stage;

wherein the pull-up circuit comprises a first controllable switch, a first terminal of the first controllable switch receiving the clock signal of the current stage, a control terminal of the first controllable switch is connected to the transmission circuit and the pull-down circuit, a second terminal of the first controllable switch is connected to the transmission circuit and the scanning signal output terminal; and wherein when the scanning driving circuit is not operated, the second voltage terminal is controlled to be at high potential, and when the scanning driving circuit is operated, the second voltage terminal becomes a low potential, and the low potential is the same with the first voltage terminal; and wherein the pull-down maintenance circuit comprises fourth to ninth controllable switches, a control terminal of the fourth controllable switch is connected to a control terminal of the fifth controllable switch, a first terminal of the fourth controllable switch is connected to the pull-up control circuit, a second terminal of the fourth controllable switch is connected to the first voltage terminal, a first terminal of the fifth controllable switch is connected to the scanning signal output terminal, a second terminal of the fifth controllable switch is connected to the first voltage terminal, a second terminal of the sixth controllable switch is connected to a first terminal of the seventh controllable switch and the control terminal of the fifth controllable switch, a first terminal of the sixth controllable switch is connected to a first terminal of the eighth controllable switch and a control terminal of the eighth controllable switch and to receive the high voltage direct current voltage, a control terminal of the sixth controllable switch is connected to the second terminal of the eighth controllable switch and a first terminal of the ninth controllable switch, a control terminal of the seventh controllable switch is connected to a control terminal of the ninth controllable switch and the pull-up control circuit, a second terminal of the seventh controllable switch and a second terminal of the ninth controllable switch are both connected to the second voltage terminal.

2. A scanning driving circuit, comprising:

a first voltage terminal; a second voltage terminal;

a scanning signal output terminal for outputting a high level scanning signal or a low level scanning signal; a pull-up circuit for receiving a clock signal of a current stage and controlling the scanning signal output terminal to output of a high level scanning signal according to the clock signal of the current stage;

a transmission circuit, connected to the pull-up circuit for outputting a high level stage transmission signal of a current stage;

a pull-up control circuit, connected to the transmission circuit and receiving a stage transmission signal of a previous stage for charging the pull-up control signal point to pull up the potential of the pull-up control signal point to a high level;

a pull-down maintenance circuit connected to the pull-up control circuit, the first voltage terminal and the second voltage terminal and receiving a high voltage direct current voltage, for maintaining the low level of the pull-up control signal point, and the low level of the scanning signal outputted from the scanning signal output terminal;

a bootstrap circuit for raising the potential of the pull-up control signal point; and a pull-down circuit connected to the transmission circuit, the pull-down maintenance circuit, and the first voltage terminal, for receiving a stage transmission signal of a next stage and controlling the scanning signal output terminal to output the low level scanning signal in accordance with the stage transmission signal of the next stage;

wherein the pull-down maintenance circuit comprises fourth to ninth controllable switches, a control terminal of the fourth controllable switch is connected to a control terminal of the fifth controllable switch, a first terminal of the fourth controllable switch is connected to the pull-up control circuit, a second terminal of the fourth controllable switch is connected to the first voltage terminal, a first terminal of the fifth controllable switch is connected to the scanning signal output terminal, a second terminal of the fifth controllable switch is connected to the first voltage terminal, a second terminal of the sixth controllable switch is connected to a first terminal of the seventh controllable switch and the control terminal of the fifth controllable switch, a first terminal of the sixth controllable switch is connected to a first terminal of the eighth controllable switch and a control terminal of the eighth controllable switch and to receive the high voltage direct current voltage, a control terminal of the sixth controllable switch is connected to the second terminal of the eighth controllable switch and a first terminal of the ninth controllable switch, a control terminal of the seventh controllable switch is connected to a control terminal of the ninth controllable switch and the pull-up control circuit, a second terminal of the seventh controllable switch and a second terminal of the ninth controllable switch are both connected to the second voltage terminal.

3. The scanning driving circuit according to claim 2, wherein the pull-up circuit comprising a first controllable switch, a first terminal of the first controllable switch receiving the clock signal of the current stage, a control terminal of the first controllable switch is connected to the transmission circuit and the pull-down circuit, a second terminal of the first controllable switch is connected to the transmission circuit and the scanning signal output terminal.

4. The scanning driving circuit according to claim 3, wherein the transmission circuit comprising a second controllable switch, a control terminal of the second controllable switch is connected to the control terminal of the first controllable switch, and a first terminal of the second controllable switch is connected to the first terminal of the first controllable switch, and a second terminal of the second controllable switch outputs the stage transmission signal of the current stage.

5. The scanning driving circuit according to claim 4, wherein, the pull-up control circuit comprising a third controllable switch, a control terminal of the third controllable switch is connected to a first terminal of the third controllable switch and receives the stage transmission signal of the previous stage, a second terminal of the third controllable switch is connected to the control terminal of the second controllable switch and the pull-down maintenance circuit.

6. The scanning driving circuit according to claim 4, wherein the pull-down circuit comprising a tenth controllable switch and an eleventh controllable switch, a control terminal of the tenth controllable switch is connected to a control terminal of the eleventh controllable switch and receives the stage transmission signal of the next stage, a first terminal of the tenth controllable switch is connected to the control terminal of the second controllable switch, a second terminal of the tenth controllable switch is connected the first voltage terminal, a first terminal of the eleventh controllable switch is connected to the scanning signal output terminal and the second terminal of the first controllable switch, a second terminal of the eleventh controllable switch is connected to the first voltage terminal.

7. The scanning driving circuit according to claim 6, wherein the bootstrap circuit comprising a bootstrap capacitor, a first terminal of the bootstrap capacitor is connected to the control terminal of the first controllable switch, a second terminal of the bootstrap capacitor is connected to the scanning signal output terminal.

8. The scanning driving circuit according to claim 6, wherein the first to eleventh controllable switches are N-type thin film transistors, the control terminals, the first terminals and the second terminals of the first to twelfth controllable switches are respectively correspond to gates, sources and drains of the N-type thin film transistor.

9. The scanning driving circuit according to claim 2, wherein when the scanning driving circuit is not operated, the second voltage terminal is controlled to be at high potential, and when the scanning driving circuit is operated, the second voltage terminal becomes a low potential, and the low potential is the same with the first voltage terminal.

10. A display apparatus, wherein the display apparatus comprises a scanning driving circuit, the scanning driving circuit comprising: a first voltage terminal; a second voltage terminal; a scanning signal output terminal for outputting a high level scanning signal or a low level scanning signal; a pull-up circuit for receiving a clock signal of a current stage and controlling the scanning signal output terminal to output of a high level scanning signal according to the clock signal of the current stage;

a transmission circuit, connected to the pull-up circuit for outputting a high level stage transmission signal of a current stage;

a pull-up control circuit, connected to the transmission circuit and receiving a stage transmission signal of a previous stage for charging the pull-up control signal point to pull up the potential of the pull-up control signal point to a high level;

a pull-down maintenance circuit connected to the pull-up control circuit, the first voltage terminal and the second voltage terminal and receiving a high voltage direct current voltage, for maintaining the low level of the pull-up control signal point, and the low level of the scanning signal outputted from the scanning signal output terminal;

a bootstrap circuit for raising the potential of the pull-up control signal point; and a pull-down circuit connected to the transmission circuit, the pull-down maintenance circuit, and the first voltage terminal, for receiving a stage transmission signal of a next stage and controlling the scanning signal output terminal to output the low level scanning signal in accordance with the stage transmission signal of the next stage;

wherein the pull-down maintenance circuit comprises fourth to ninth controllable switches, a control terminal of the fourth controllable switch is connected to a control terminal of the fifth controllable switch, a first terminal of the fourth controllable switch is connected to the pull-up control circuit, a second terminal of the fourth controllable switch is connected to the first voltage terminal, a first terminal of the fifth controllable switch is connected to the scanning signal output terminal, a second terminal of the fifth controllable switch is connected to the first voltage terminal, a second terminal of the sixth controllable switch is connected to a first terminal of the seventh controllable switch and the control terminal of the fifth controllable switch, a first terminal of the sixth controllable switch is connected to a first terminal of the eighth controllable switch and a control terminal of the eighth controllable switch and to receive the high voltage direct current voltage, a control terminal of the sixth controllable switch is connected to the second terminal of the eighth controllable switch and a first terminal of the ninth controllable switch, a control terminal of the seventh controllable switch is connected to a control terminal of the ninth controllable switch and the pull-up control circuit, a second terminal of the seventh controllable switch and a second terminal of the ninth controllable switch are both connected to the second voltage terminal.

11. The display apparatus according to claim 10, wherein the pull-up circuit comprising a first controllable switch, a first terminal of the first controllable switch receiving the clock signal of the current stage, a control terminal of the first controllable switch is connected to the transmission circuit and the pull-down circuit, a second terminal of the first controllable switch is connected to the transmission circuit and the scanning signal output terminal.

12. The display apparatus according to claim 11, wherein the transmission circuit comprising a second controllable switch, a control terminal of the second controllable switch is connected to the control terminal of the first controllable switch, and a first terminal of the second controllable switch is connected to the first terminal of the first controllable switch, and a second terminal of the second controllable switch outputs the stage transmission signal of the current stage.

13. The display apparatus according to claim 12, wherein, the pull-up control circuit comprising a third controllable switch, a control terminal of the third controllable switch is connected to a first terminal of the third controllable switch and receives the stage transmission signal of the previous stage, a second terminal of the third controllable switch is connected to the control terminal of the second controllable switch and the pull-down maintenance circuit.

14. The display apparatus according to claim 12, wherein the pull-down circuit comprising a tenth controllable switch and an eleventh controllable switch, a control terminal of the tenth controllable switch is connected to a control terminal of the eleventh controllable switch and receives the stage transmission signal of the next stage, a first terminal of the tenth controllable switch is connected to the control terminal of the second controllable switch, a second terminal of the tenth controllable switch is connected the first voltage terminal, a first terminal of the eleventh controllable switch is connected to the scanning signal output terminal and the second terminal of the first controllable switch, a second terminal of the eleventh controllable switch is connected to the first voltage terminal.

15. The display apparatus according to claim 14, wherein the bootstrap circuit comprising a bootstrap capacitor, a first terminal of the bootstrap capacitor is connected to the control terminal of the first controllable switch, a second terminal of the bootstrap capacitor is connected to the scanning signal output terminal.

16. The display apparatus according to claim 14, wherein the first to eleventh controllable switches are N-type thin film transistors, the control terminals, the first terminals and the second terminals of the first to twelfth controllable switches are respectively correspond to gates, sources and drains of the N-type thin film transistor.

17. The display apparatus according to claim 10, wherein when the scanning driving circuit is not operated, the second voltage terminal is controlled to be at high potential, and when the scanning driving circuit is operated, the second voltage terminal becomes a low potential, and the low potential is the same with the first voltage terminal.

* * * * *